United States Patent [19]

Dorpmund et al.

[11] Patent Number: 4,527,765

[45] Date of Patent: Jul. 9, 1985

[54] DEVICE FOR LOCKING PIVOTALLY MOUNTED CORNER POSTS OF LOADING PLATFORMS

[75] Inventors: Willi Dorpmund; Volker Kreienbrink, both of Elze, Fed. Rep. of Germany

[73] Assignee: Graaff, Kommanditgesellschaft, Elze, Fed. Rep. of Germany

[21] Appl. No.: 267,186

[22] Filed: May 26, 1981

[30] Foreign Application Priority Data

May 27, 1980 [DE] Fed. Rep. of Germany ..... 3020064

[51] Int. Cl.[3] ..... A47B 91/00

[52] U.S. Cl. ..... 248/346

[58] Field of Search ..... 248/240.4, 293, 346, 248/439; 108/56.1, 53.1; 403/102

[56] References Cited

U.S. PATENT DOCUMENTS

| | | | |
|---|---|---|---|
| 2,854,148 | 9/1958 | Mattos et al. | 248/293 X |
| 2,956,763 | 10/1960 | D'Arca | 108/53.1 |
| 3,327,654 | 6/1967 | Duncan et al. | 108/53.1 |
| 3,541,566 | 11/1970 | Riebsamen | 403/102 X |
| 3,680,448 | 8/1972 | Ballingall et al. | 403/102 X |
| 3,752,332 | 8/1973 | Theurer | 108/56.1 |
| 3,807,581 | 4/1974 | Nichols | 108/56.1 X |
| 3,850,295 | 11/1974 | Black | 108/56.1 X |
| 4,262,872 | 4/1981 | Kodet | 248/318 X |
| 4,309,013 | 1/1982 | Howe | 248/346 |
| 4,314,686 | 2/1982 | März | 248/346 |
| 4,353,520 | 10/1982 | Jansson | 248/346 |

*Primary Examiner*—William H. Schultz

[57] ABSTRACT

A device for locking a corner post of a loading platform, or flat, in its vertical operative position, including a pin at the lower end of the post accommodated by a socket fixed with respect to the platform, and a torsion spring which is stressed during the vertical downward movement of the post when the post is erected. A hook-shaped catch on the post engages a plate fixed with respect to the platform to prevent accidental movement of the post from its operative position. A lever, arranged at an angle to the corner post, interconnects the corner post and the torsion spring. The torsion spring is also stressed when the corner post is folded down upon the platform in its collapsed condition.

10 Claims, 6 Drawing Figures

DEVICE FOR LOCKING PIVOTALLY MOUNTED CORNER POSTS OF LOADING PLATFORMS

Loading platforms, or so-called flats, are known, which were developed from large containers, and are used for holding bulky less-than-carload freight. They consist of a rectangular base plate whose dimensions correspond to those of the base of large containers. A corner post is positioned at each corner. The two corner posts at one end of the plate can be connected with each other by means of a front wall. In their vertical use position, the corner posts serve to limit the base plate. They are provided at their upper ends with metal fittings, to which lifting tackle may be attached, in order to lift the flat vertically by means of the corner posts which, in this position, are connected rigidly with the base plate. The metal fittings, and the corresponding metal fittings on the underside of the flats, are so designed that the flats can be stacked on top of each other or with corresponding containers.

The flats are designed as folding flats, so that only small space is required for transporting empty flats. The corner posts are connected by hinges with the base plate. In the vertical use position of the corner posts, the swiveling feature of the connection between the corner posts and the base plate is blocked, i.e., the corner posts are locked in their vertical positions relative to the base plate. For transporting the empty flats, the locking arrangement is released so that the corner posts can be swiveled about a transverse axis and laid down on the base plate. When the corner posts assume their horizontal position, the flats can be stacked on top of each other, in which position, for example, five flats stacked on top of each other have the same height as one flat with the corner posts in their operative position.

The present invention is concerned with the design of the mounting of the corner posts on the base plate, and especially with locking them to the base plate.

It is well known that, for this purpose, the lower end of each corner post can be mounted on the base plate with a cross pin, about which the corner post can be pivoted. Locking can be accomplished in various ways. The simplest way of locking is to use a locking pin, which can be moved in a longitudinal direction parallel to the pivot pin. In its activated position, the locking pin is put through holes in the corner post and the base plate, so that the corner post and base plate are locked relative to each other and the corner post cannot be swiveled about the pivot pin relative to the base plate. In order to swivel the corner post, the locking pin is taken out of the holes in the base plate, out of the holes in the corner post, or out of the holes in the base plate and the corner post, so that the corner post is free to swivel about the pivot pin relative to the base plate and can be laid down on the base plate or brought into its vertical operative position.

The pivot pin and locking pin can be arranged on top of each other. However, a horizontal foot which, in the vertical operative position of the corner post, points in the direction of the transverse median plane, may also be mounted at the lower end of the corner post. The free end of this foot, facing the transverse median plane, is permanently pivotally mounted to the base plate, while the locking pin is mounted in the region of the apex of the angle, formed by the corner post and the foot, in the same horizontal plane as the pivot pin or in a plane displaced above or below this plane. Due to the foot, there can be a vertical distance between a horizontal corner post and base plate, which is required, for example, when the corner posts are longer than half the length of the base plate and, in the laid down position, the corner posts at one end of the base plate lie directly on the base plate, while the corner posts at the other end of the base plate lie on the first mentioned corner posts.

In other folding flats, two parallel cross pins are attached to the lower end of the respective corner posts at a particular vertical distance from each other. With these, the corner post is fixed in the vertical use position in a vertical longitudinal slit of the base plate. In order to lay it down on the base plate, the corner post is initially lifted until the upper of the two cross pins has passed out of the longitudinal slit. The corner post can then be pivoted about the longitudinal axis of the other cross pin, which has remained in the longitudinal slit. This arrangement represents a particularly simple, but nevertheless effective means of locking. Its disadvantage is that for lifting the corner post of larger folding flats, not inconsiderable physical exertion is required from the operating personnel.

In view of the background described above, an object of the invention is to provide a folding flat which combines the advantages of the known folding flats but does not have their disadvantages. According to the invention, it is possible to use vertically adjustable corner posts which can be locked, in the vertical operative position, to the base plate and released from the base plate without requiring considerable physical effort. At the same time, it is easy to set up and to service this arrangement which, in consequence of being operationally safe and not very susceptible to breakdown, is particularly suitable for the rough operation of large containers, without its use however being limited to large containers.

Two different embodiments of the invention are shown in the drawings and described below. In the drawings.

Figure 1:
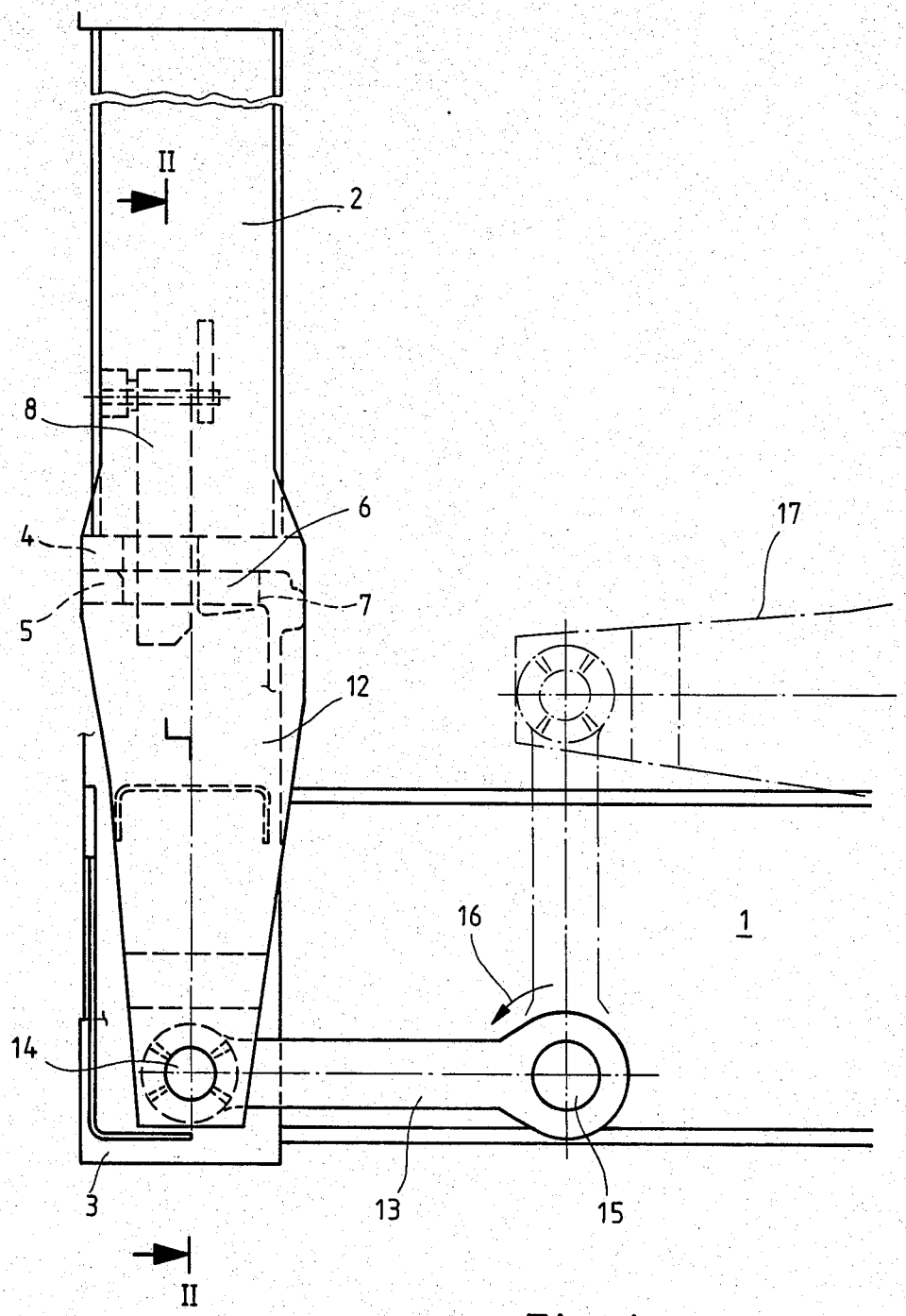
FIG. 1 is a simplified, fragmentary side elevational view of one end of a folding flat according to the invention.

The folding flat consists essentially of a horizontal, rectangular base plate 1 and corner posts 2, one of which is mounted at each corner of the base plate. The four corner posts can be pivotally mounted independently of each other to the base plate 1, or the two corner posts at one end of the base plate can be connected to each other by a front wall, so that the corner posts at the ends of the base plate can only be pivoted together relative to the base plate.

At each corner of the base plate 1, a short, vertical corner column 3 is rigidly connected to the base plate. In the operative position of the flats, one of the corner posts 2 is connected to the top of each of the corner columns 3. In this position, the respective corner post 2, having a horizontal base plate 4, is supported on a cover plate 5 of the short corner column 3, the cover plate 5 being parallel to the base plate 4.

When the base plate 4 of corner post 2 is lying on cover plate 5 of corner column 3, a fixed vertical pin 6 at the lower end of the corner post 2 protrudes into an opening 7 in the cover plate 5 of the corner column 3, the opening 7 surrounding the pin 6 with appropriate clearance in the horizontal direction. In addition, in the region of the lower end of the corner post 2 on which it is pivotally mounted, there is below cover plate 5 a catch 8 having a locking lug 9, the neck of catch 8 passing through openings 10 in the cover plate 5 and the base plate 4. The horizontal clearance between the neck of the catch 8 and the edges of the openings 10 is so dimensioned that, through the pivotal motion of catch 8 and its supporting pin 11, the lug 9 of the catch lies against the underside of the cover plate 5 (shown in solid lines in FIG. 2) or moves away from this position (shown in broken lines in FIG. 2).

The fixed pin 6 and the opening 7 form a socket support with which the corner post 2 is secured in its vertical position relative to the corner column 3, and therefore relative to the base plate 1. The socket support is in turn secured with catch 8 acting together with the upper cover plate 5, so that pin 6 cannot accidentally come out of the opening 7.

Joined to the side of the lower end of corner post 2 is an extension plate 12 which, in the vertical position of the corner post 2, lies next to the corner column 3. A lever 13 is connected to the lower end of the extension plate 12. The longitudinal axes of the corner post 2 and lever 13 are at an angle of about 90° to each other, the angle being adjustable within limits when assembling the corner post and the lever. In the installed state, however, the angle is fixed in view of the installation relationships.

The end of the lever 13 opposite the coupling 14, between the corner post 2 and lever 13, is fixed to one end of a torsion spring 15 (see FIG. 6) in the form of a torsion rod. The longitudinal axis of spring 15 intersects perpendicularly the plane of pivoting of the corner post 2 and the other end of the spring is clamped torsionally rigid in a support 17 in the base plate 1. The pivoting motion of the corner post 2 takes place about the longitudinal axis of the torsion spring 15, whereby the torsional stress of the spring is altered.

Figure 6:
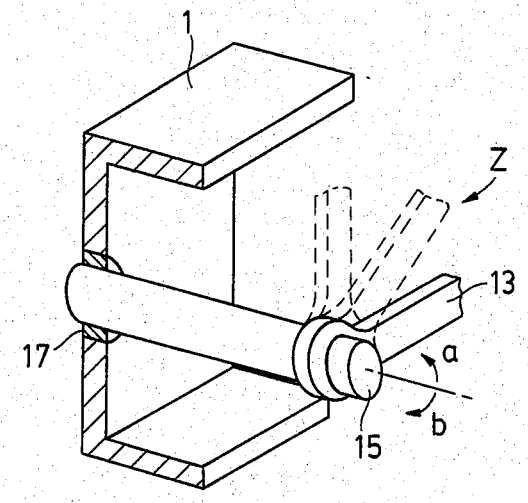
FIG. 6 is a fragmentary perspective view of a torsion spring interconnection between parts of the folding flat.

The torsion spring 15 is so installed that it can be shifted from a stressless position, corresponding to the inclined position of lever 13 indicated by the arrow Z in FIG. 6, in two opposite circumferential directions "a and b" and, in so doing, be stressed.

Figure 2:
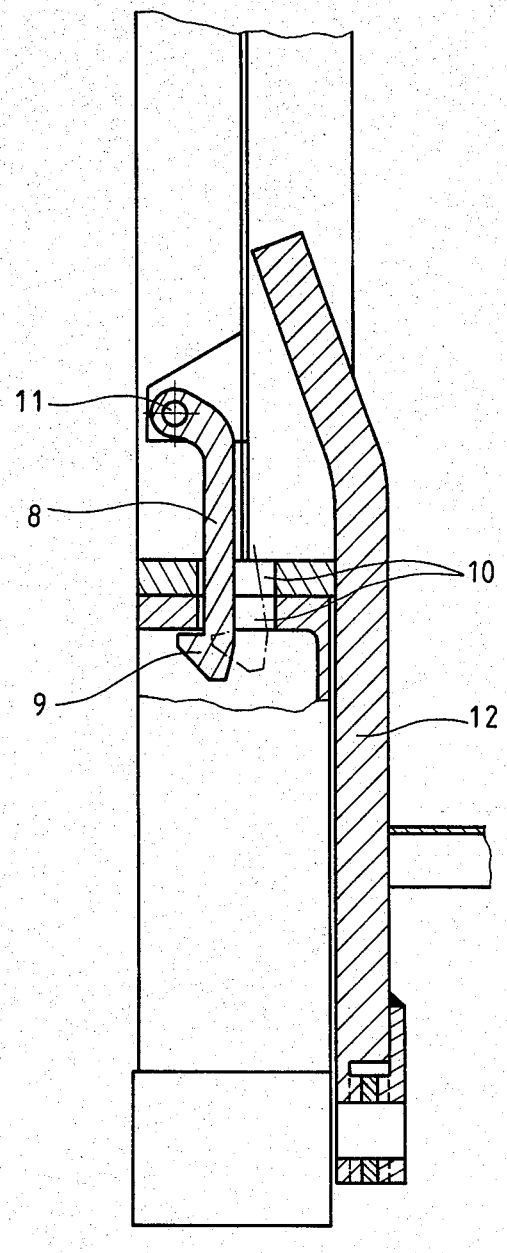
FIG. 2 is a cross-sectional view taken along line II—II of FIG. 1.

In FIGS. 1 and 2, the vertical position of the corner post 2 is shown, in which it is locked to the base plate, the flat can be lifted, for example by a lifting tackle, which engages the upper metal fittings of the corner post. In so doing, the tension spring 15 is prestressed in the direction of arrow 16.

Catch 8 can be pivoted so that its locking bolt 9 is freed from the cover plate 5 of the short corner column 3, whereby the corner post 2, by itself or together with a second correspondingly designed and mounted corner post at the same end of the base plate 1, is able to lie down on base plate 1. Consequently, the stress on torsion spring 15 is released in the direction of arrow 16 in order to lift corner post 2 in a vertical direction far enough that pin 6 can be lifted out of opening 7. The horizontal component of the circular movement about the longitudinal axis of the torsion spring 15 is made possible by a correspondingly curved design on the wall of opening 7, so that as the corner post 2 is lifted, there is no constraint between pin 6 and opening 7.

Once the corner post 2 has been lifted, by the release of stress in the torsion spring 15, far enough that its pin 6 is free of opening 7, it can be pivoted further manually about the longitudinal axis of the torsion spring 15, until it lies on base plate 1, as shown by the dot-dash line 17 of FIG. 1. At the same time, torsion spring 15 is stressed in the direction of arrow 16, thereby preventing a hard impact of corner post 2 on base plate 1 and facilitating a later reerection of corner post 2. In the horizontal position, corner post 2 can be secured relative to base plate 1 by means of suitable bolts.

Figure 3:
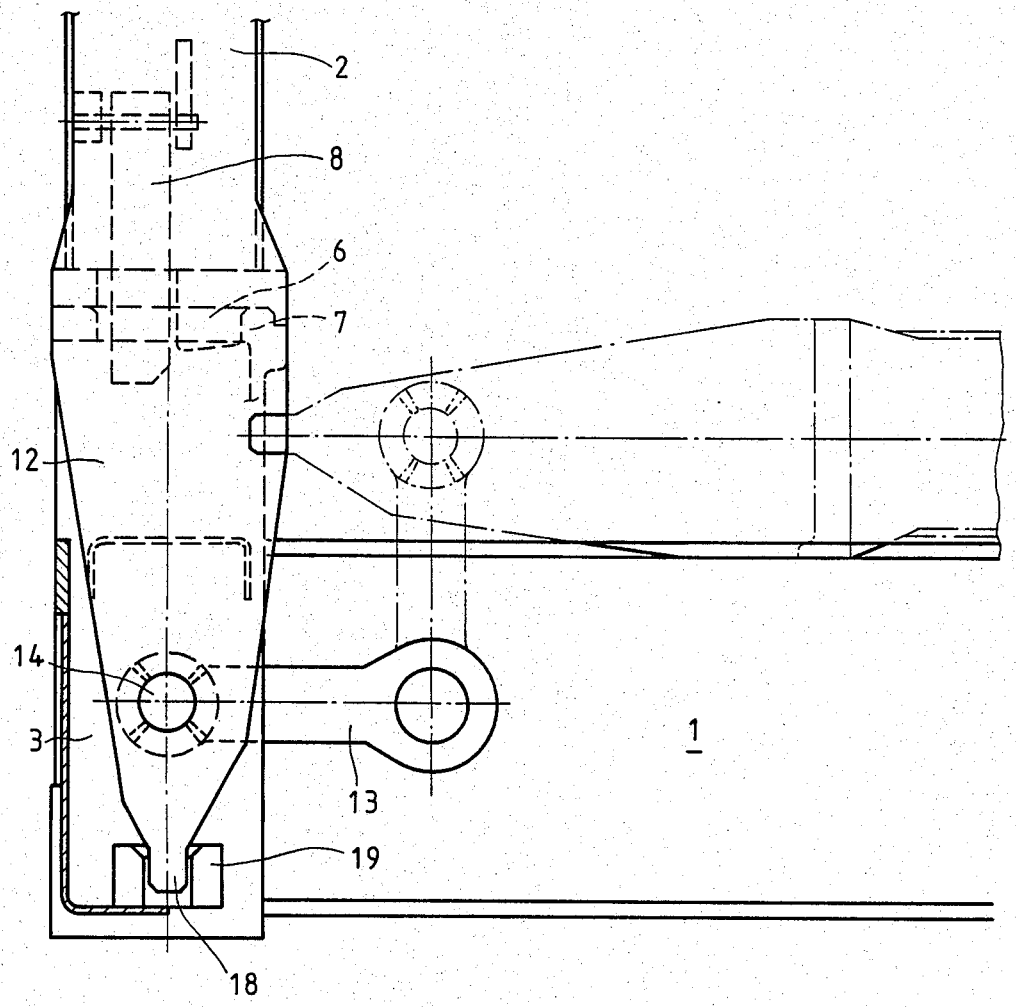
FIG. 3 is a view similar to FIG. 1 of a further development of the folding flat shown in FIGS. 1 and 2.

The arrangement shown in FIG. 3 differs from that of FIGS. 1 and 2 in that, in addition to the upper socket support 6 and 7, a lower socket support including a vertical pin 18 and a corresponding pin socket 19 are provided. The extension plate 12 is extended further downwards over coupling 14, between corner post 2 and lever 13, and provided at its lower end with pin 18. Base plate 1 has pin socket 19. When the corner post is raised into its vertical position and the torsion spring 15 stressed in the direction of arrow 16, pins 6 and 18 of the lower and upper supports enter the corresponding sockets 7 and 19. On the other hand, the two pins leave the sockets when the torsion spring, as its tension is being released, lifts the corner post vertically.

Figure 4:
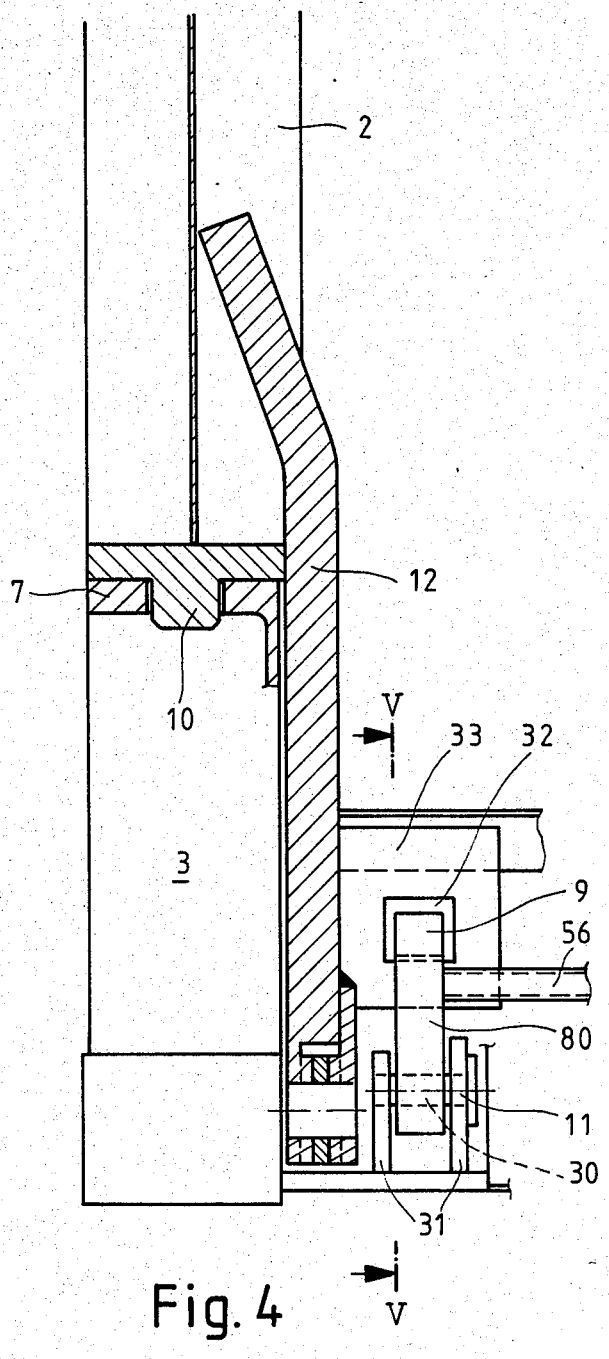
FIG. 4 is a view similar to FIG. 2 of another embodiment of the invention.
Figure 5:
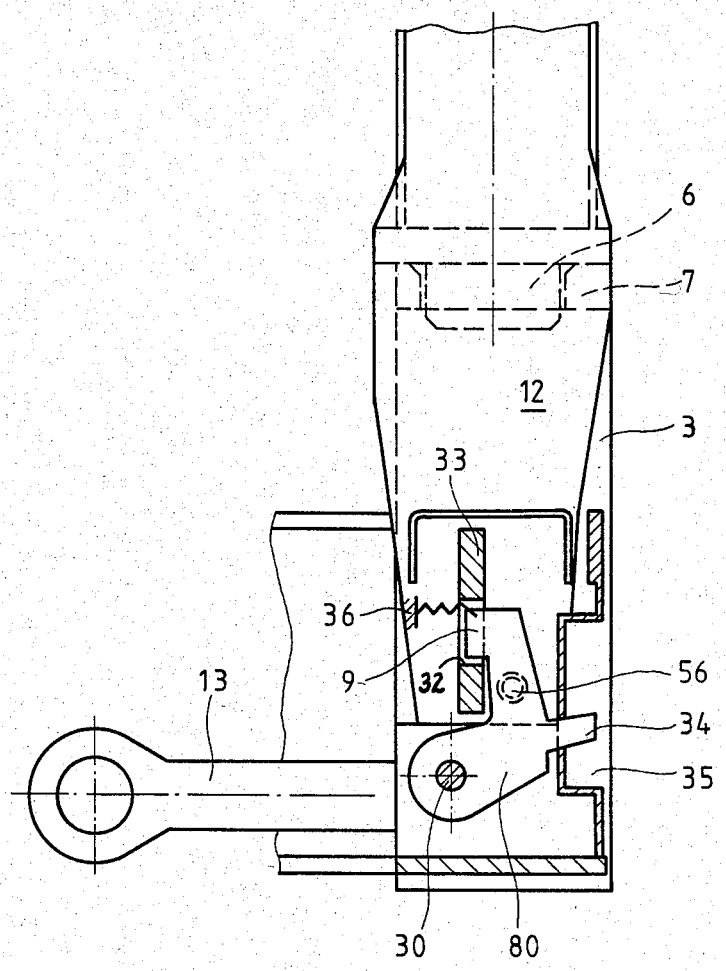
FIG. 5 is a cross-sectional view taken along line V—V of FIG. 4.

Yet another embodiment, which is distinguished by particular robustness and consequently by operational safety, is shown in two mutually perpendicular sections in FIGS. 4 and 5.

In the arrangement shown in FIGS. 4 and 5, the locking mechanism having the catch 8, which is provided in the previously described solutions, is eliminated. Consequently, the fixed pin 6 of the upper socket support can be designed very solidly and robustly and pin socket 7 must of course also be dimensioned correspondingly. Catch 80, which corresponds to catch 8 of the embodiment shown in FIGS. 1 to 3, is pivotally mounted near the lower end of corner column 3 on a pin 30, which is held in end plates 31 of platform 1. By pivoting about pin 30, catch 80 can engage, with its locking lug 9, a window 32 of a plate 33 on the extension 12. In a different end position, the catch 80 is free of the plate 33 and its window 32. Catch 80 can be caused to pivot by means of arm 34, which passes through a correspondingly dimensioned opening in the column wall. Arm 34 is accessible within a niche 35 of the corresponding corner column 3 without protruding beyond the contours of the column. In the locking position, catch 80 is held by a spring 36, the force of which must be overcome when pivoting the catch 80 into the unlocked position. Arm 34 can be activated by the foot of an operator.

In order to be able to activate the locking devices at each end of the pallet simultaneously and from one corner of a pallet, the two catches at the two corners of each end of the pallet are connected to each other by a coupling rod 56. Accordingly, with one step on arm 34, both catches 80 with their locking lugs 9 are pulled out of the windows 32 and both corner posts can be laid down. Although in such a case only one spring 36 is required for introducing the locking lug 9 into the window 32, it is nevertheless more advisable to provide each catch 80 with a spring. These springs could also be replaced by counterweights.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A folding flat comprising:

a base plate having at least one corner, a support means fixed to the base plate in the region of the base plate corner, a corner post movable with respect to the base plate between an erect condition generally perpendicular to the base plate and a collapsed condition generally parallel to the base plate, a pin projecting from one of the support means and corner post and a cooperating socket for accommodating the pin being located in the other of the support means and corner post, the pin and socket being interengaged when the corner post is erect and being separable in a vertical direction when the base plate is in horizontal orientation, lever means secured to the corner post and pivotally mounted on the base plate at a point horizontally spaced from the corner post, whereby rotation of the corner post, from its erect condition toward its collapsed condition, about the pivot point of the lever means causes relative substantially vertical movement between the pin and socket to separate them, and resilient means arranged to be stressed during the substantially vertical movement of the corner post which results in interengagement of the pin and socket, during the final movement of the corner post to its erect condition, whereby the resilient means tends to aid vertical movement of the corner post for separation of the pin and socket upon the initial movement of the corner post from its erect condition toward its collapsed condition.

2. A folding flat as defined in claim 1 wherein the resilient means is a torsion spring coaxial with the pivot axis of the lever means.

3. A folding flat as defined in claim 1 wherein the pin projects longitudinally from the corner post, and the socket is defined by the support means.

4. A folding flat as defined in claim 1 wherein the pin has smooth side surfaces which fit against the corresponding side edges of the socket when the corner post is erect.

5. A folding flat as defined in claim 1 including a movable catch carried by one of the support means and the corner post and cooperable with a member carried by the other of the support means and the corner post to prevent movement of the corner post out of its erect condition.

6. A folding flat as defined in claim 1 including means for adjusting the angle between the corner post and the lever means.

7. A folding flat as defined in claim 1 wherein the resilient means is stressed during the final movement of the corner post to its collapsed condition, whereby the resilient means tends to aid the initial movement of the corner post from its collapsed condition toward its erect condition.

8. A folding flat as defined in claim 1 including a second pin projecting from one of the support means and corner post and a second cooperating socket for accommodating the second pin being located in the other of the support means and corner post, the second pin and socket being spaced along the length of the corner post from the first-mentioned pin and socket.

9. A folding flat as defined in claim 5 including a spring for urging the catch into cooperable engagement with the member.

10. A folding flat as defined in claim 9 wherein the base plate has at least two corners, support means fixed to the base plate in the region of each corner, a corner post movable with respect to each support means, a movable catch carried by one of the support means and the corner post at each corner of the base, and means for rigidly coupling the two catches to each other so that they can be actuated simultaneously from either corner of the base.

* * * * *